US007812586B2

(12) United States Patent
Soldano et al.

(10) Patent No.: US 7,812,586 B2
(45) Date of Patent: Oct. 12, 2010

(54) ONE CYCLE CONTROL PFC CIRCUIT WITH DYNAMIC GAIN MODULATION

(75) Inventors: Marco Soldano, San Jose, CA (US); Ramanan Natarajan, Torrance, CA (US)

(73) Assignee: International Rectifier Corporation, El Segundo, CA (US)

( * ) Notice: Subject to any disclaimer, the term of this patent is extended or adjusted under 35 U.S.C. 154(b) by 184 days.

(21) Appl. No.: 11/876,464

(22) Filed: Oct. 22, 2007

(65) Prior Publication Data

US 2008/0094040 A1 Apr. 24, 2008

Related U.S. Application Data

(60) Provisional application No. 60/862,257, filed on Oct. 20, 2006.

(51) Int. Cl.
*G05F 1/70* (2006.01)
*G05F 1/613* (2006.01)

(52) U.S. Cl. ..... 323/285; 363/89; 323/207; 323/222

(58) Field of Classification Search ..... 323/222, 323/223, 282, 284, 285, 299, 205, 207; 363/89
See application file for complete search history.

(56) References Cited

U.S. PATENT DOCUMENTS 5,278,490 A 1/1994 Smedley ..... 323/284
5,532,918 A * 7/1996 Mayrand et al. ..... 363/89
5,689,176 A * 11/1997 Deloy ..... 323/222
6,275,397 B1 8/2001 McClain ..... 363/89
6,680,604 B2 * 1/2004 Muratov et al. ..... 323/285
6,900,623 B2 * 5/2005 Yang et al. ..... 323/282
6,919,715 B2 * 7/2005 Muratov et al. ..... 323/285
6,949,915 B2 9/2005 Stanley ..... 323/207
6,967,851 B2 11/2005 Yang et al. ..... 363/16
7,064,527 B2 * 6/2006 Adragna ..... 323/207
7,368,895 B2 * 5/2008 Shih ..... 323/276
2005/0105311 A1 5/2005 Soldano ..... 363/89
2006/0043942 A1 3/2006 Cohen ..... 323/207
2006/0164047 A1 * 7/2006 Ressel ..... 323/222

OTHER PUBLICATIONS

International Search Report dated Apr. 2, 2008.

* cited by examiner

*Primary Examiner*—Gary L Laxton
(74) *Attorney, Agent, or Firm*—Farjami & Farjami LLP

(57) ABSTRACT

A one cycle control power factor correction control circuit in accordance with an embodiment of the present application includes a first input operable to receive a signal indicative of an input voltage to the voltage converter, a second input operable to receive a signal indicative of an inductor current in an inductor of the voltage converter and an amplifier operable to amplify the signal indicative of the inductor current, wherein a gain of the amplifier is based on the signal indicative of the input voltage.

14 Claims, 7 Drawing Sheets

ONE CYCLE CONTROL PFC CIRCUIT WITH DYNAMIC GAIN MODULATION

CROSS-REFERENCE TO RELATED APPLICATIONS

The present application claims benefit of and priority to U.S. Provisional Application Ser. No. 60/862,267 filed Oct. 20, 2006 entitled DYNAMIC MODULATION OF CURRENT SENSE AMPLIFIER GAIN FOR OVER POWER LIMITATION IN ONE CYCLE CONTROL POWER FACTOR CORRECTION METHODOLOGY, the entire contents of which are hereby incorporated by reference herein.

BACKGROUND

1. Field of the Invention

The present invention relates to a one cycle control power factor correction (PFC) control circuit with dynamic gain control. More specifically, the present application relates to a one cycle control PFC control circuit for a switching converter in which a gain of a current sense amplifier is varied based on the input line voltage.

2. Related Art

Power factor correction control in switching converters typically involves modulating the duty cycle of the switching element in the converter such that the input appears to be purely resistive. For those control circuits that use a one cycle control technique, for example, in controlling a boost converter, the output of the voltage error amplifier in the converter control loop, that is, the error voltage $V_{COMP}$, is integrated over the switching cycle to produce a ramp voltage. The ramp signal is then typically compared to a reference voltage which is typically generated by a combination of inductor sense current voltage and $V_{COMP}$ to determine the duty cycle of the boost converter power switch. One non-limiting example of such a control circuit is Assignee International Rectifier Corporation's IR1150 uPFC One Cycle Control PFC Integrated Circuit.

FIG. 1A is a block diagram of the IR1150. FIG. 1B is a schematic of an application circuit in which the IR1150 is suitable for use. The IR1150 is preferably used to control the duty cycle of the switch Q1 of the boost converter illustrated in FIG. 1B. Specifically, the switch Q1 is controlled to convert an input voltage $V_{IN}$, typically provided from an AC line voltage via a rectifier bridge (BRIDGE), as illustrated in FIG. 1B, into a desired output voltage VOUT. Specifically, the IR1150 controls the gate of the switch Q1 via a control signal provided at the output GATE pin (pin 8). The control signal turns the switch Q1 ON and OFF to provide the desired output voltage VOUT.

While the operation of the IR 1150 is well known, a brief review of its features is useful. The IR 1150 includes a COM pin (pin 1) that provides a connection to ground and a supply pin VCC (pin 7) which is preferably connected to a supply voltage $V_{CC}$ to supply power to the IC. The feedback pin VFB (pin 6) is an input which provides a signal indicative of the output voltage VOUT. Preferably, this signal is supplied via the voltage divider formed by the feedback resistors RFB1, RFB2, RFB3. The compensation pin COMP (pin 5) is connected to external circuitry (Rgm, Cz, Cp) that compensates the internal voltage loop and soft start time. This pin is also connected to the output of the voltage error amplifier 20 (see FIG. 1A). The current sense input ISNS (pin 3) is the inverting current sense input and peak current limit. The voltage provided at this pin is the negative voltage drop, sensed across the system current sense resistor Rs which represents the inductor current through the inductor L1. The over voltage protection pin OVP (pin 4) is connected to an input of the over voltage protection comparator 30 which prevents an over voltage condition. More specifically, the over voltage protection pin OVP is provided with a signal indicative of the output voltage, preferably via the voltage divider provided by the resistors ROV1, ROV2, ROV3 in FIG. 1B, for example. If the output voltage exceeds a threshold level, the IR1150 preferably enters a fault mode.

One problem that arises from the one cycle control technique mentioned above and used in the IR1150 is that the system cannot provide overpower protection when the line voltage is any higher than the minimum permissible line voltage that the system is designed for.

Accordingly, it would be desirable to provide a control circuit that avoids these problems.

SUMMARY OF THE INVENTION

It is an object of the present invention to provide a one cycle control power factor correction control circuit for a switching converter in which the gain of a current sense amplifier is varied based on the input line voltage to provide overpower protection through a wide range of input line voltages.

A control circuit utilizing one cycle control power factor correction to control a voltage converter in accordance with an embodiment of the present application includes a first input operable to receive a signal indicative of an input voltage to the voltage converter, a second input operable to receive a signal indicative of an inductor current in an inductor of the voltage converter and an amplifier operable to amplify the signal indicative of the inductor current, wherein a gain of the amplifier is based on the signal indicative of the input voltage.

A method of controlling a voltage converter utilizing one cycle control power factor correction includes receiving a signal indicative of an input voltage to the voltage converter via first input, receiving a signal indicative of an inductor current in an inductor of the voltage converter via a second input and amplifying the signal indicative of the inductor current via an amplifier to provide an amplifier output signal, wherein a gain of the amplifier is based on the signal indicative of the input voltage.

Other features and advantages of the present invention will become apparent from the following description of the invention which refers to the accompanying drawings.

BRIEF DESCRIPTION OF THE DRAWING(S)

DETAILED DESCRIPTION OF EMBODIMENTS OF THE INVENTION

As noted above, one problem that arises in one cycle control power factor correction control circuits is that they cannot provide overpower protection through the entire range of permissible input line voltages. This is primarily due to the fact that the gain of the current sense amplifier remains constant. Thus, in a control circuit in accordance with the present application, the gain of the current sense amplifier is varied based on the input line voltage to allow for proper overpower protection over a wide range of input line voltages.

When using one cycle control, the variation in the error signal $V_{COMP}$ with the system line and load can be expressed as follows:

$$V_{COMP}=G_{DC}\cdot V_{SNS,pk}/(1-D)$$

Where $V_{SNS,pk}$ corresponds to the current sensing voltage and D represents the duty cycle at the peak of the AC line voltage for the specific line/load combination.

Based on this relationship, the following dependence between the error voltage $V_{COMP}$ and the line voltage is implied:

$$V_{COMP}\propto G_{DC}\cdot I_{IN,pk}/V_{IN,pk}$$

Where $V_{IN,pk}$ is the peak input voltage and $I_{IN,pk}$ is the peak input current. Thus, for a particular load, represented as $P_{OUT}$, the relationship between the error voltage and input line voltage may be expressed as $$V_{COMP}\propto G_{DC}\cdot P_{OUT}/V_{IN,pk}^2$$

Figure 1A:
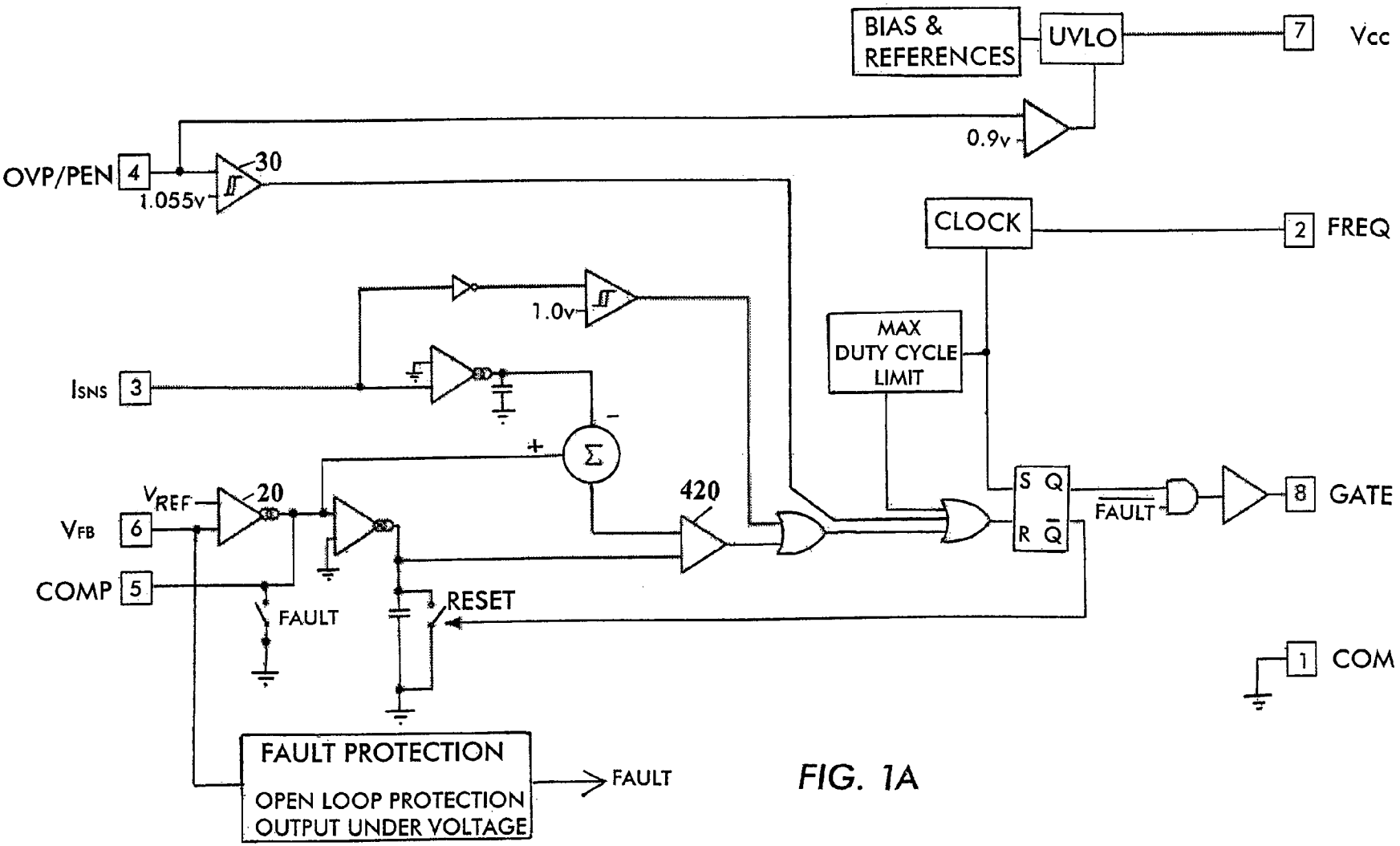
FIG. 1A is a block diagram of a conventional one cycle control PFC integrated circuit.
Figure 1B:
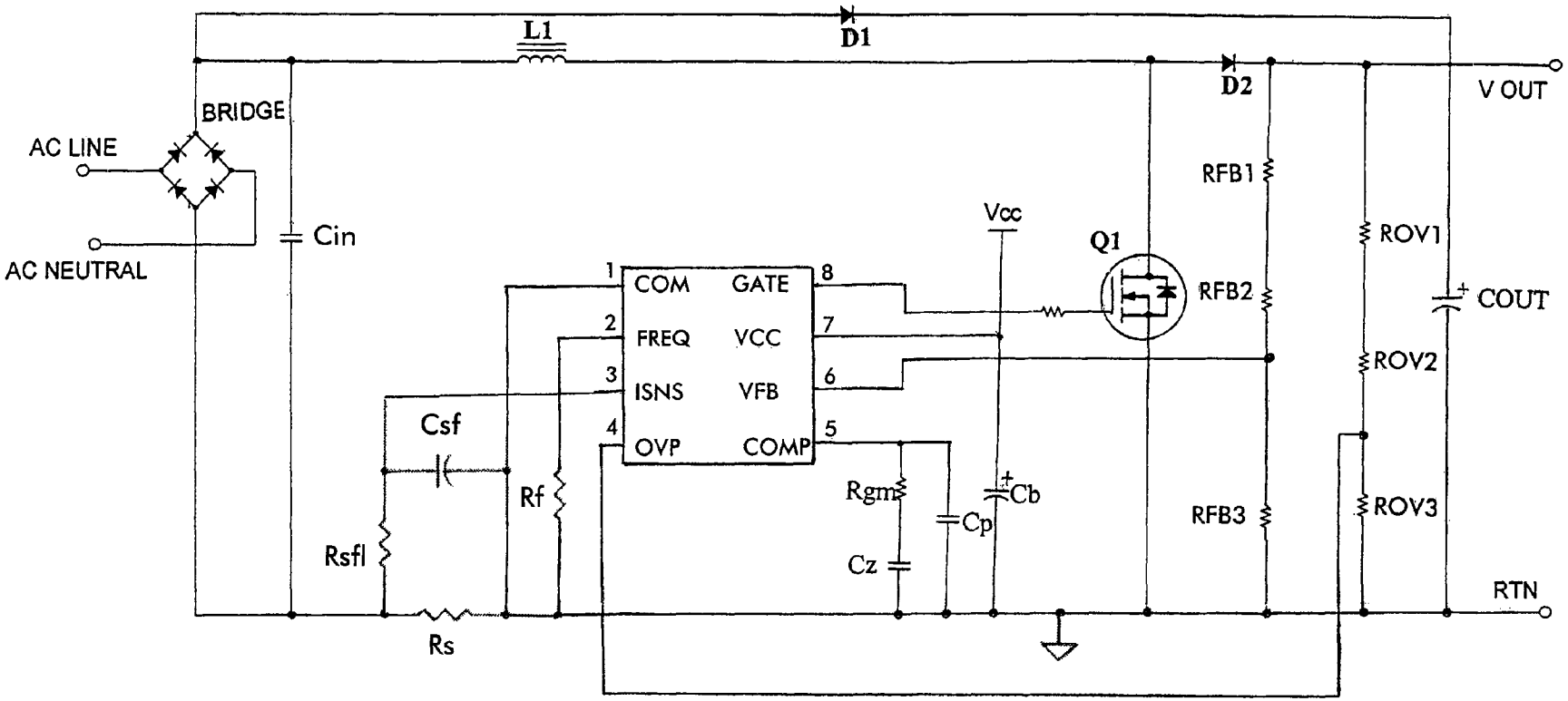
FIG. 1B is a schematic of an application circuit suitable for use with the one cycle control PFC integrated circuit of FIG. 1.
Figure 2:
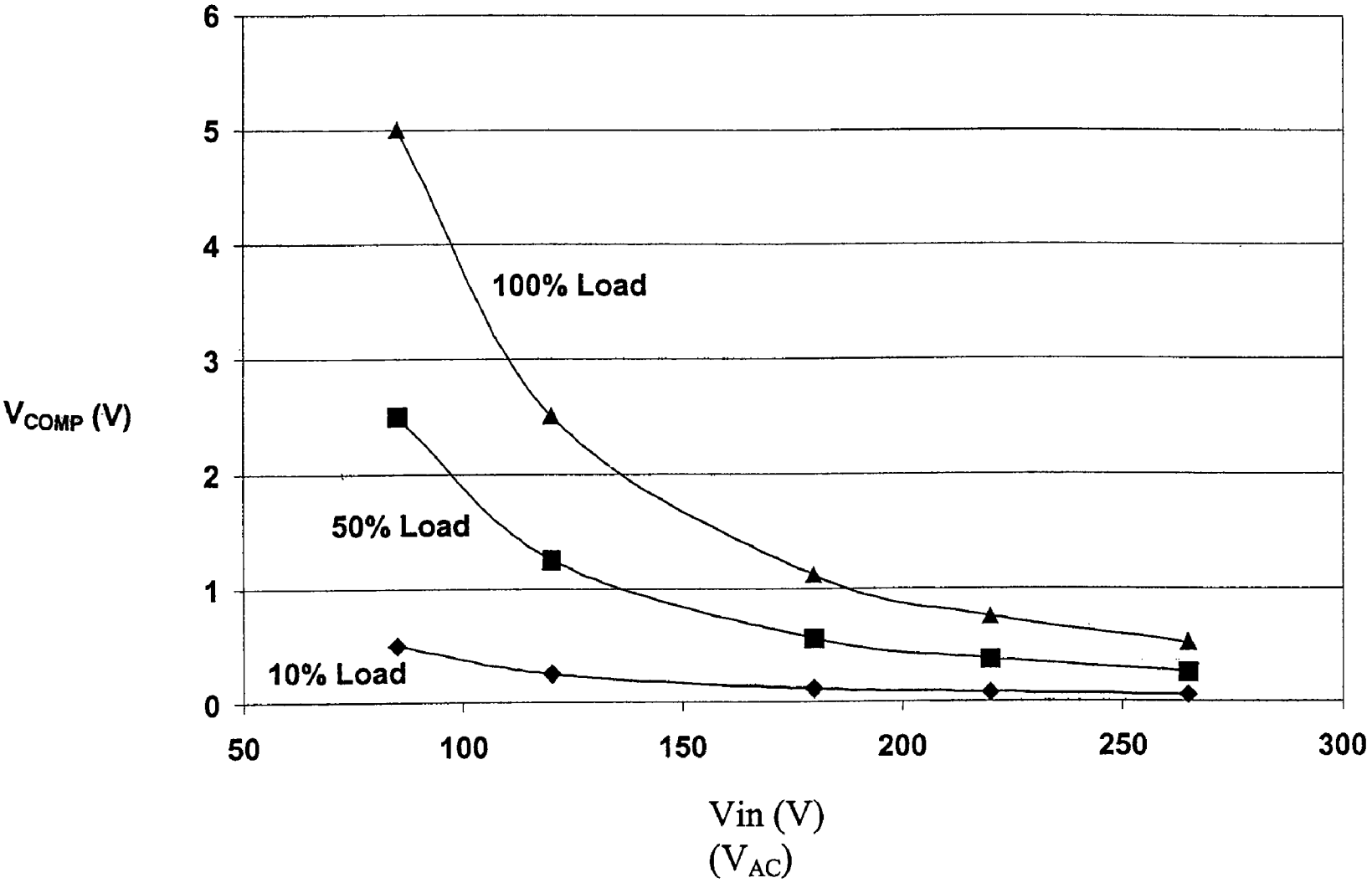
FIG. 2 is a graph illustrating the relationship between the error voltage signal and input line voltage in the one cycle control PFC integrated circuit of FIGS. 1-2.

Thus, for a given load condition, the value of $V_{COMP}$ falls progressively with an increase in line voltage as an inverse square function. This is illustrated in the graph of FIG. 2, for example. FIG. 2 illustrates a relationship between the input line voltage $V_{IN}$ ($V_{IN,pk}$) and the error voltage $V_{COMP}$ similar to that of the IR1150, for example, illustrated in FIGS. 1A and 1B.

However, in a one cycle control circuit, overpower protection is typically provided based on saturation of the $V_{COMP}$ voltage at a certain predetermined maximum value, $V_{COMP,Eff}$. The system is typically designed such that $V_{COMP}$ reaches $V_{COMP,Eff}$ when the converter is running at its maximum possible load and with its minimum permissible line voltage. Thus, if the line voltage ($V_{IN}$, $V_{IN,pk}$) for the converter goes any higher, $V_{COMP}$ will fall below saturation even if the maximum load is present, and thus, open up more room for variation of the control voltage for the converter to process more power. Naturally, this is an undesirable result since it allows the converter to operate in an overpower state which could cause damage.

Figure 5:
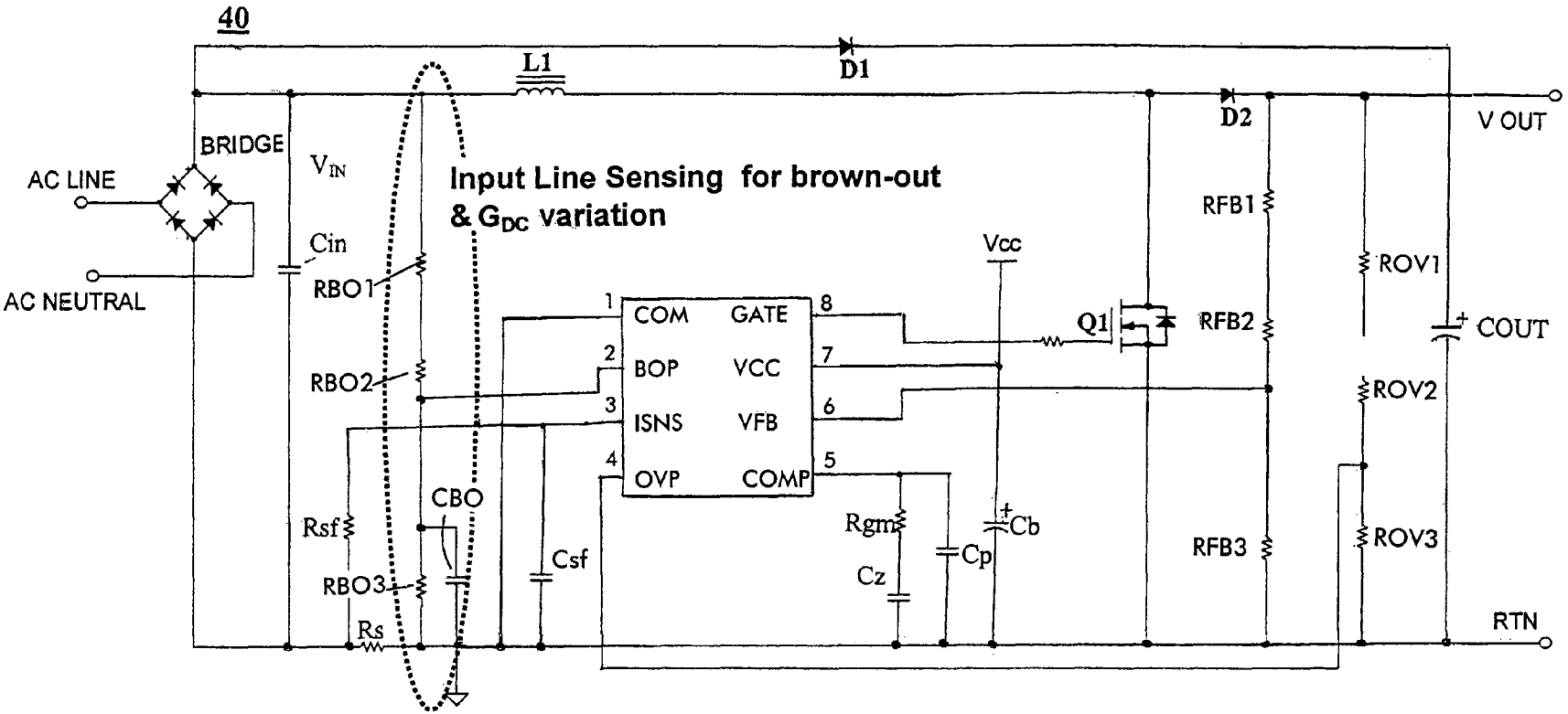
FIG. 5 is a schematic of an application diagram in which a one cycle control power factor correction control circuit in accordance with an embodiment of the present application is suitable for use.
Figure 6:
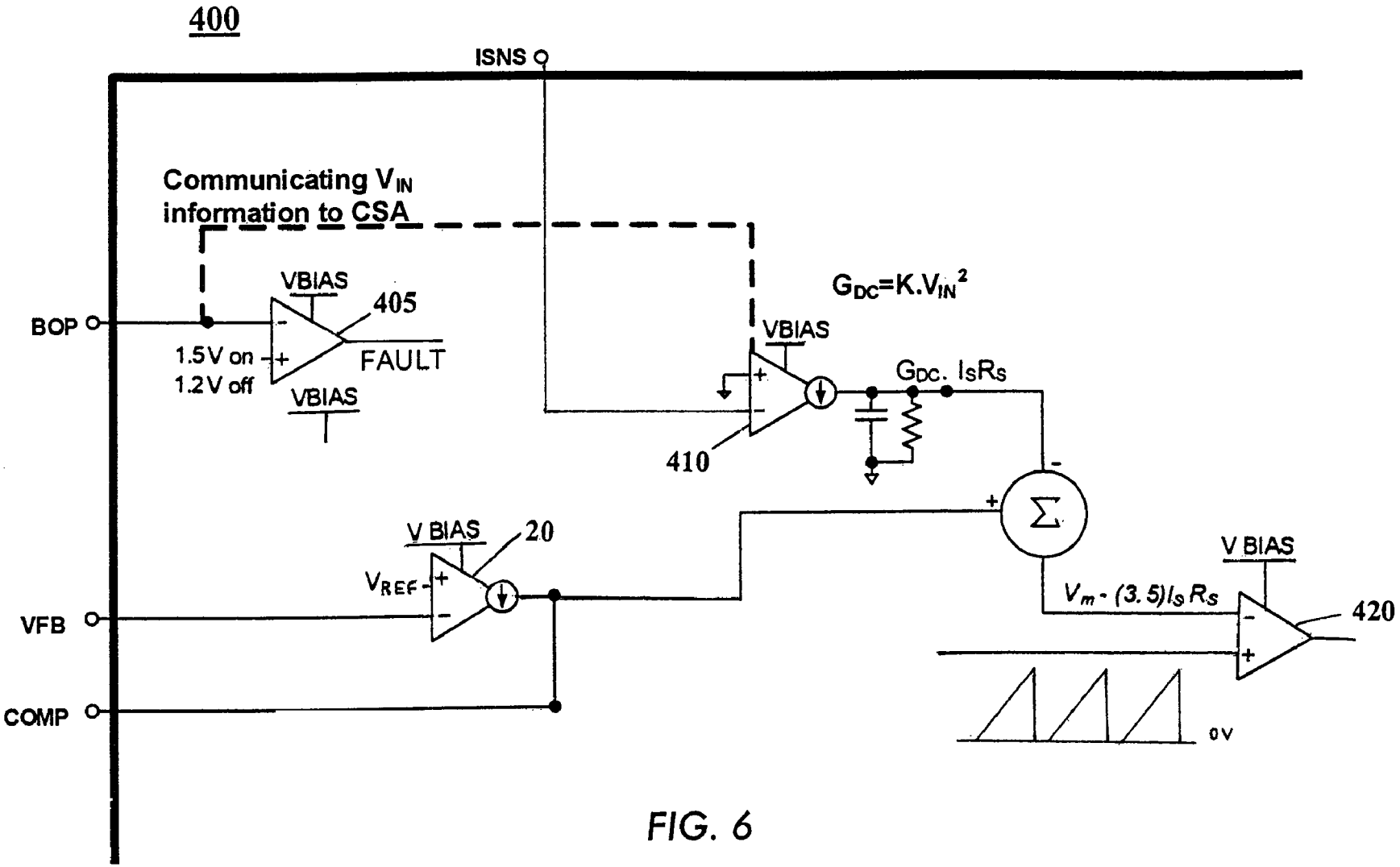
FIG. 6 is a block diagram of a portion of a one cycle control power factor correction control circuit in accordance with an embodiment of the present application.

FIG. 6 is a block diagram of a portion of a one cycle control PFC control circuit 400 in accordance with an embodiment of the present application in which a gain of the current sense amplifier 410 is varied based on the input voltage $V_{IN}$. FIG. 5 is an illustration of an application circuit in which the control circuit 400 may be used.

In the control circuit 400 and method of the present application, the gain $G_{DC}$ of the current sense amplifier 410 is varied as a function of the input line voltage $V_{IN}$ ($V_{IN,pk}$). As a result, the dependence of the error voltage $V_{COMP}$ on the line voltage can be modified such that the value of $V_{COMP}$ will remain constant at any given load irrespective of the line voltage. This will ensure that the saturation of $V_{COMP}$ will occur whenever the maximum permissible load is exceeded, regardless of the line voltage, and thus, true overpower protection is provided. That is, the error voltage $V_{COMP}$ will be independent of the input voltage $V_{IN}$.

The desired variation of the gain $G_{DC}$ is determined based on a study of the $V_{COMP}$ function. As is noted above, $$V_{COMP}\propto G_{DC}\cdot P_{OUT}/V_{IN,pk}^2$$

Thus, if the gain $G_{DC}$ is increased as a square function of the input voltage, $V_{COMP}$ will be independent of the line voltage and may be expressed as $$V_{COMP}\propto G_{DC}\cdot P_{OUT}\cdot K$$

Where K is a proportional constant between the gain $G_{DC}$ and $1/V_{IN}^2$ as shown $$G_{DC}=KV_{IN}^2$$

Figure 3:
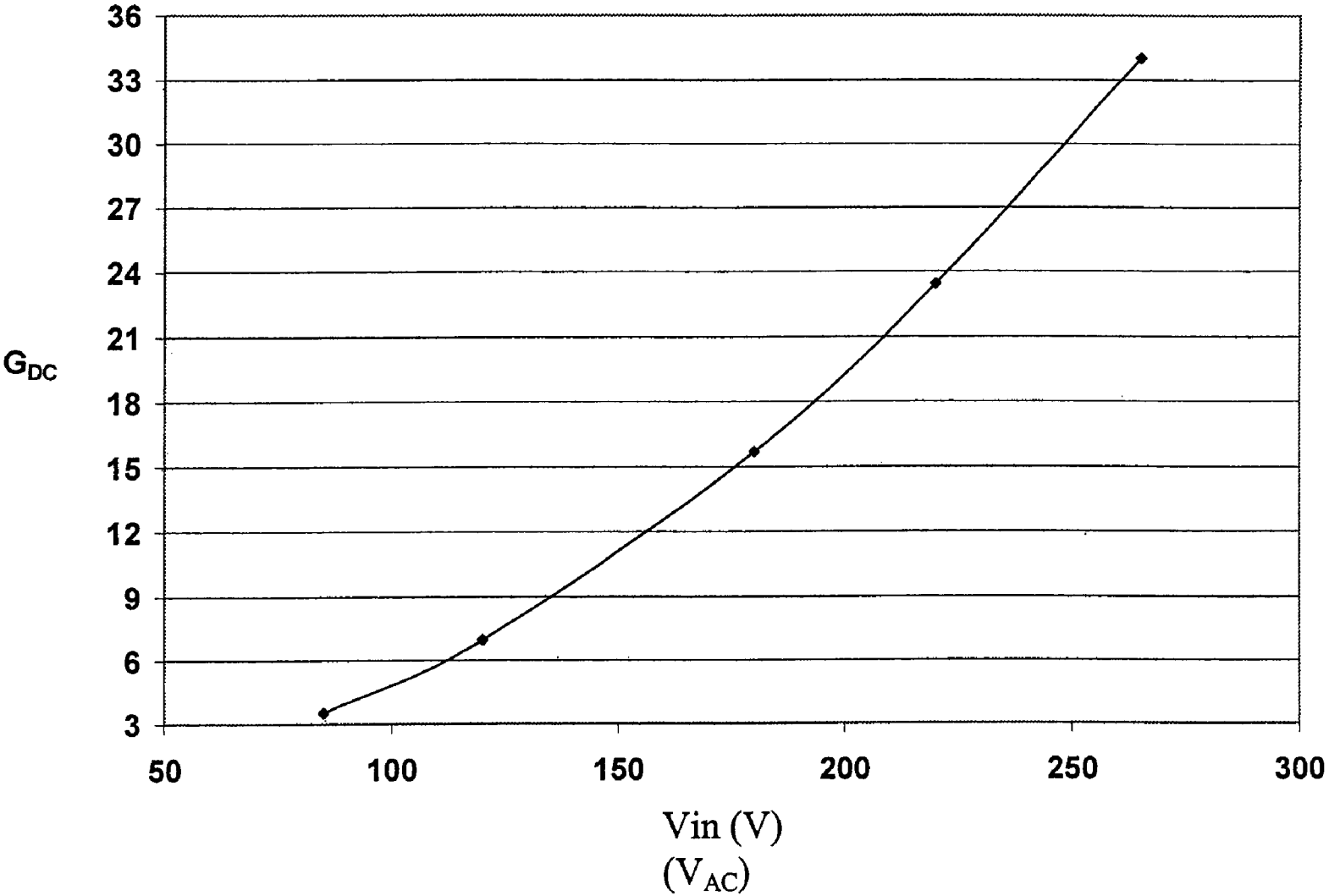
FIG. 3 is a graph illustrating a desired relationship between the gain of the current sense amplifier and the input line voltage in a one cycle control power factor correction control circuit in accordance with an embodiment of the present application.
Figure 4:
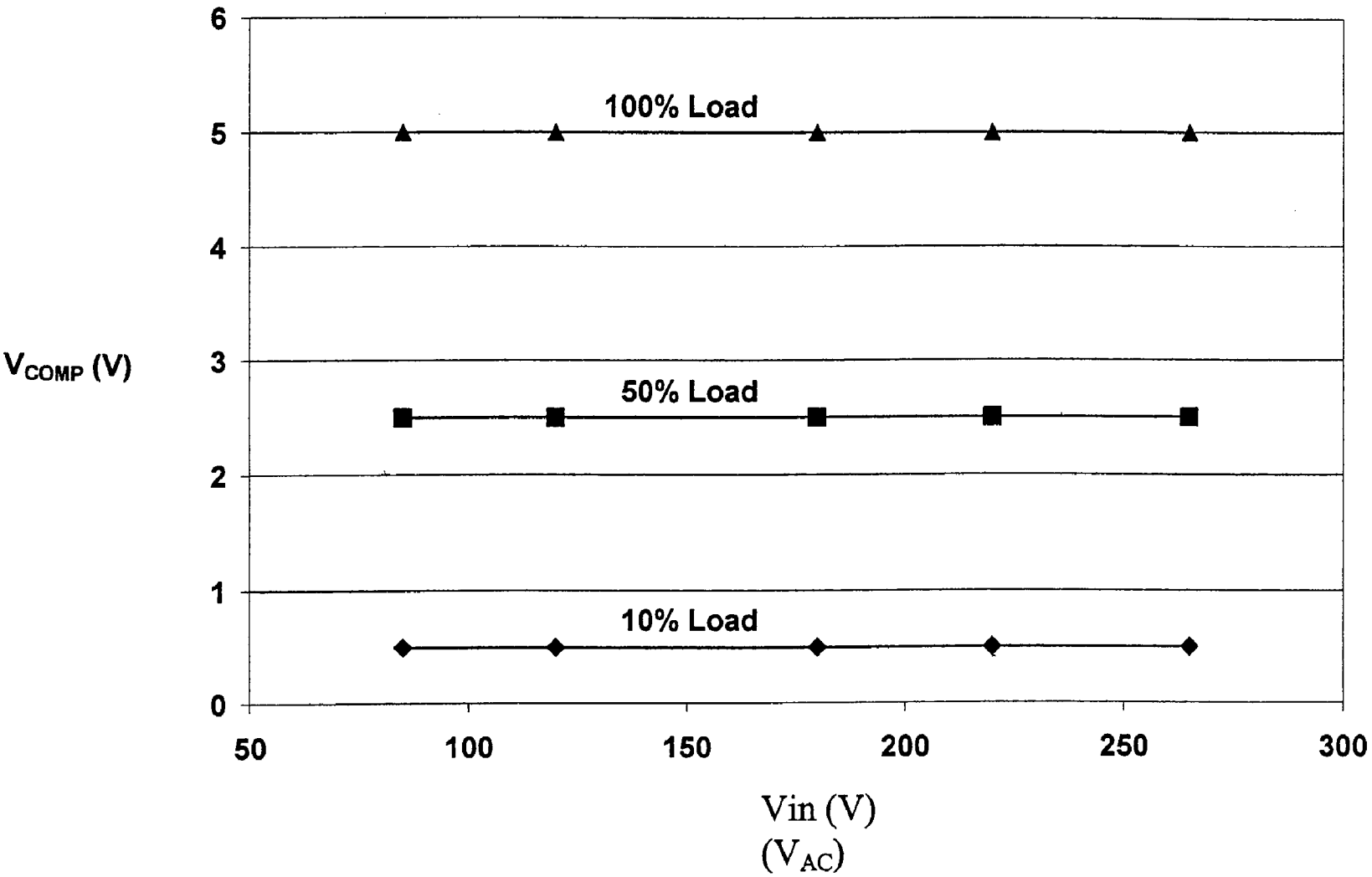
FIG. 4 is a graph illustrating the relationship between the error voltage signal and input line voltage in a one cycle control power factor correction control circuit in accordance with an embodiment of the present application.

Thus, $V_{COMP}$ is determined solely based on the load condition $P_{OUT}$. The desired variation of the gain $G_{DC}$ with the line voltage $V_{IN}$ for the control circuit 400 of the present application is illustrated in the graph of FIG. 3. As illustrated, the gain $G_{DC}$ is increased as the input voltage increases. FIG. 4, on the other hand, illustrates how the error voltage $V_{COMP}$ remains substantially constant for any given load condition even as the input line voltage increases. Further, it is noted that the gain $G_{DC}$ only needs to be varied over a range of about 10 fold in order to accomplish the desired goal. That is, as can be seen in FIG. 3, the gain $G_{DC}$ varies between approximately 3 and 36 for the entire range of desired input voltage values.

While in a preferred embodiment, the gain $G_{DC}$ is increased as a square of the input voltage $V_{IN}$, it is noted that any increase in the gain with the input voltage is beneficial to reduce the reliance of the value $V_{COMP}$ on the line voltage, and thus, improves overpower protection available when compared to conventional one cycle control.

The application circuit 40 of FIG. 5 is similar to that utilized in combination with the IR1150 one cycle control PFC integrated circuit described above and illustrated in FIG. 1B. Thus, common elements are referred to with common reference symbols. The only substantive differences between the application circuit 40 of FIG. 5 and that of FIG. 1B is that the control circuit 400 of the present application replaces the IR1150 and the resistors RBO1, RBO2, RBO3 are provided to allow for brownout protection.

As is noted above, in a control circuit in accordance with the present application, the gain $G_{DC}$ of the current sense amplifier 410 (see FIG. 6) in the control circuit 400 is preferably increased based on the input line voltage $V_{IN}$ ($V_{IN,pk}$). Thus, the control circuit 400 of the present application preferably includes a means to monitor the input line voltage. In a typical one cycle control circuit, such line sensing not necessary. However, it is common to provide brownout protection in control circuits. In a preferred embodiment, as illustrated in FIG. 5, a signal indicative of the input line voltage $V_{IN}$ is provided to a brownout protection pin BOP (pin 2). This signal is preferably obtained from a divider formed by the resistors RBO1, RBO2, RBO 3. When the input voltage drops below a predetermined brownout threshold value for a predetermined time, a brownout condition is indicated and the control circuit 400 is preferably sent into a fault mode. Brownout protection is generally well known, and thus, the specifics thereof are not discussed in detail herein. An RC filter circuit formed by the resistor RBO3 and the capacitor CBO may also be provided to smooth the signal provided to the pin BOP.

FIG. 6 illustrates a block diagram of a portion of the circuit 400 to illustrate how the gain $G_{DC}$ of the current sense amplifier 410 is varied based on the input voltage $V_{IN}$. As can be seen in FIG. 6, the current sense amplifier 410 is preferably provided with a signal from the brownout protection pin BOP (pin 2 in FIG. 5) that is indicative of the input voltage $V_{IN}$. The gain $G_{DC}$ of the amplifier 410 is then varied in accordance with the input voltage $V_{IN}$, as described above.

By varying the gain $G_{DC}$ of the amplifier 410, the undesirable dependence of the error voltage $V_{COMP}$ on the input voltage $V_{IN}$ is avoided. Thus, $V_{COMP}$ remains substantially the same regardless of the input line voltage $V_{IN}$ as is illustrated in FIG. 4, for example. Otherwise, the circuit 400 operates in substantially the same manner as the one cycle control PFC IC IR1150 mentioned above, except that it also includes brownout protection as mentioned above. That is, the duty cycle of the switch Q1 is set based on the comparison of the ramp signal illustrated in FIG. 6, for example, with a reference signal Vm that is based on the output of the current sense amplifier 410 and the error voltage $V_{COMP}$ via PWM comparator 420. Further, the error signal $V_{COMP}$ is obtained in the traditional manner by comparing a feedback voltage (Vfb) provided via the feedback pin VFB which is indicative of the output voltage VOUT. The feedback voltage is preferably provided via the voltage divider formed by the resistors RFB1, RFB2 and RFB3 illustrated in FIG. 5. This voltage is compared to a reference voltage to provide the error voltage $V_{COMP}$. In addition, the circuit 400 provides brownout protection, preferably by comparing the signal indicative of the input voltage provided to the brownout pin BOP with a predetermined brownout threshold value via the brownout protection comparator 405. The output FAULT signal of the comparator 405 shuts down the control circuit 400 when a brownout condition is detected as described above. The circuit 400 is preferably powered by a supply voltage Vcc preferably from an external supply provided to the pin VCC (pin 7). Over voltage protection is preferably provided in a manner similar to that described above with reference to the IR1150 described above. A path to ground is preferably provided via the common return terminal COM. A current sense input ISNS (pin 3) is also provided to provide a signal indicative of the current supplied to the inductor L1 as mentioned above.

The control circuit 400 of the present application is described and illustrated as an integrated circuit with 8 pins, however, it need not be limited to this specific embodiment. Further, the control circuit of the present application has been described largely with reference to the IR1150, however, it is noted that varying the gain of the current sense amplifier in accordance with the input line voltage would provide similar benefits in any power factor correction control circuit. That is, increasing the gain of a current sense amplifier as the input line voltage increases will improve overpower protection in any power factor correction circuit.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A control circuit utilizing one cycle control power factor correction to control a voltage converter comprises:

a first input operable to receive a signal indicative of an input voltage to the voltage converter;

a second input operable to receive a signal indicative of an inductor current in an inductor of the voltage converter; and an amplifier operable to amplify the signal indicative of the inductor current, wherein a gain of the amplifier is based on the signal indicative of the input voltage and is not based on the signal indicative of the inductor current.

2. The control circuit of claim 1, wherein an output of the amplifier is used to determine a duty cycle of a switch of the voltage converter.

3. The control circuit of claim 2, wherein the first input is connected to the amplifier such that the amplifier receives the signal indicative of the input voltage.

4. The control circuit of claim 3, wherein the gain of the amplifier increases when the input voltage increases.

5. The control circuit of claim 4, wherein the gain of the amplifier is varied as a function of the square of the input voltage.

6. The control circuit of claim 5, further comprising a brownout protection comparator connected to the first input and operable to shut down the control circuit when a brownout condition is detected.

7. The control circuit of claim 6, wherein the brownout protection comparator compares the signal indicative of the input voltage to a predetermined brownout threshold voltage and shuts down the control circuit when the signal indicative of the input voltage drops below the predetermined brownout threshold for a predetermined period of time.

8. A method of controlling a voltage converter utilizing one cycle control power factor correction comprises:

receiving a signal indicative of an input voltage to the voltage converter via first input;

receiving a signal indicative of an inductor current in an inductor of the voltage converter via a second input; and amplifying the signal indicative of the inductor current via an amplifier to provide an amplifier output signal, wherein a gain of the amplifier is based on the signal indicative of the input voltage and is not based on the signal indicative of the inductor current.

9. The method of claim 8, further comprising determining a duty cycle of a switch in the voltage converter based at least in part on the amplifier output signal.

10. The method of claim 9, wherein the first input is connected to the amplifier such that the amplifier receives the signal indicative of the input voltage.

11. The method of claim 10, wherein the gain of the amplifier increases when the input voltage increases.

12. The method of claim 11, wherein the gain of the amplifier is varied as a function of the square of the input voltage.

13. The method of claim 12, further comprising: shutting the voltage converter down when a brownout condition is detected.

14. The method of claim 13, wherein the step of shutting the voltage converter down further comprises:

comparing the signal indicative of the input voltage to a predetermined brownout threshold voltage; and triggering a fault condition when the signal indicative of the input voltage drops below the brownout threshold voltage for a predetermined period of time.

* * * * *